US009596911B2

(12) United States Patent
Shah et al.

(10) Patent No.: US 9,596,911 B2
(45) Date of Patent: Mar. 21, 2017

(54) JEWELRY MOUNT

(71) Applicants: Neeta K. Shah, Manalapan, NJ (US); Kuldip P. Shah, Manalapan, NJ (US)

(72) Inventors: Neeta K. Shah, Manalapan, NJ (US); Kuldip P. Shah, Manalapan, NJ (US)

(73) Assignee: DIAMOUR INC., New York, NY (US)

( * ) Notice: Subject to any disclaimer, the term of this patent is extended or adjusted under 35 U.S.C. 154(b) by 0 days.

(21) Appl. No.: 14/251,240

(22) Filed: Apr. 11, 2014

(65) Prior Publication Data

US 2015/0289611 A1 Oct. 15, 2015

(51) Int. Cl.
*A44C 17/02* (2006.01)

(52) U.S. Cl.
CPC ..... *A44C 17/02* (2013.01); *A44C 17/0208* (2013.01)

(58) Field of Classification Search
CPC ... A44C 17/02; A44C 17/0208; A44C 15/005; A44C 25/001; A44C 25/007
USPC ..... D11/91, 92
See application file for complete search history.

(56) References Cited

U.S. PATENT DOCUMENTS

| | | | |
|---|---|---|---|
| 4,488,415 | A | 12/1984 | Jenkins |
| 4,821,533 | A | 4/1989 | Bonnefoy |
| 5,664,439 | A | 9/1997 | Dickerson |
| 6,484,537 | B2 | 11/2002 | Takessian |

FOREIGN PATENT DOCUMENTS

| | | | |
|---|---|---|---|
| BE | 1015289 | 1/2005 | |
| DE | 29618690 U1 * | 2/1997 | ..... A44C 17/02 |
| FR | 2384468 | 10/1978 | |
| FR | 2488496 | 7/1985 | |

* cited by examiner

*Primary Examiner* — Jack W Lavinder
(74) *Attorney, Agent, or Firm* — Leason Ellis LLP

(57) ABSTRACT

A jewelry mount for an ornamental article is provided that includes first and second supports. The first support defines a first receptacle sized and shaped to receive a first portion of the ornamental article. The first support further includes a plurality holes arranged about its periphery. A second support defines a second receptacle sized and shaped to receive a second portion of the ornamental article. The second support is concentrically aligned with the first support and the second support includes a plurality holes arranged about its periphery. A filament extends in a threaded manner between and among the plurality of holes in the first support and the plurality of holes in the second support so as to stitch the first and second supports together and thereby secure the ornamental article therebetween.

7 Claims, 6 Drawing Sheets

JEWELRY MOUNT

FIELD OF THE INVENTION

The present invention relates to jewelry mounts and, in particular, to jewelry mounts having a filament arranged in a stitched pattern.

BACKGROUND

Jewelry mounts come in many different types and styles. One of the more popular methods of mounting an ornamental article, such as a precious stone, in a piece of jewelry involves providing a number of prongs on the mount. The prongs are bent into position to hold the stone in place. However, the prongs can become inadvertently moved and the stone can be dislodged, which could result in damage or loss of the stone. In addition, the use of prongs provides a limited aesthetic appearance for a jewelry mount.

The present invention addresses these and other problems.

SUMMARY

According to an aspect of the present invention, a jewelry mount for an ornamental article includes first and second supports. The first support defines a first receptacle sized and shaped to receive a first portion of the ornamental article. The first support further includes a plurality holes arranged about its periphery. A second support defines a second receptacle sized and shaped to receive a second portion of the ornamental article. The second support is concentrically aligned with the first support and the second support includes a plurality holes arranged about its periphery. A filament extends in a threaded manner between and among the plurality of holes in the first support and the plurality of holes in the second support so as to stitch the first and second supports together and thereby secure the ornamental article therebetween.

According to a further aspect, at least one spacer extends between the first and second supports.

According to yet a further aspect, the first receptacle is a thru-hole.

According to a still further aspect, the second receptacle is a recess.

According to yet a still further aspect, the second receptacle is a thru-hole.

According to a further still aspect, adjacent sections of the filament angle away from each other as they extend from the second support to the first support.

According to another further aspect, the filament extends between the plurality of holes in the first support and the plurality of holes in the second support in a generally sinusoidal pattern.

According to yet another further aspect, the first and second supports support a single ornamental article therebetween.

According to another still further aspect, the first and second supports support at least two ornamental articles therebetween.

According to a further aspect, the first and second supports have a pair of receptacles on the first and second supports, respectively, for each of the ornamental articles supported therebetween.

BRIEF DESCRIPTION OF THE DRAWING FIGURES

DETAILED DESCRIPTION OF CERTAIN EMBODIMENTS OF THE INVENTION

Figure 1:
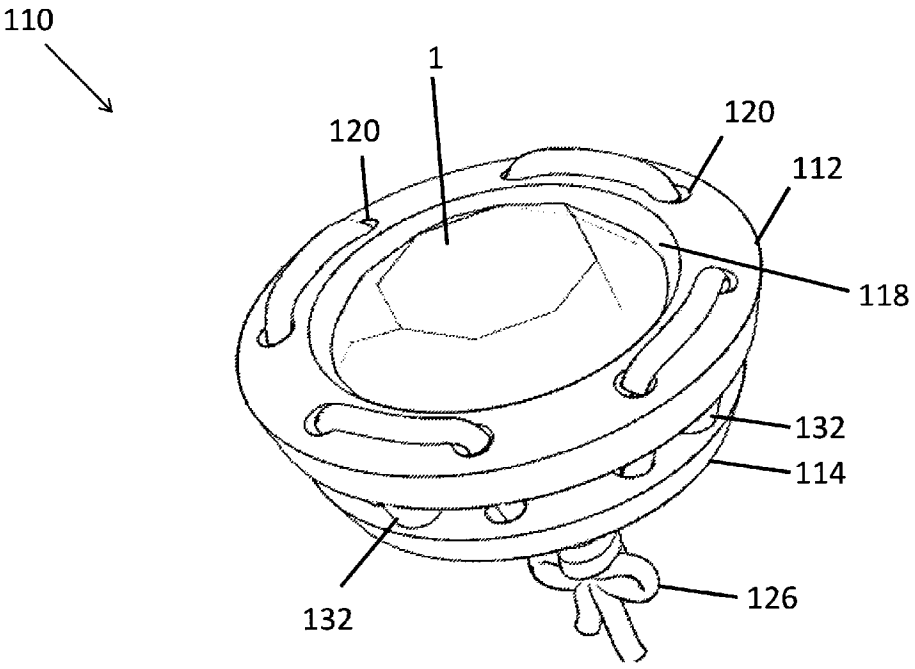
FIG. 1 is an isometric view of a jewelry mount according to an embodiment of the present invention.
Figure 2:
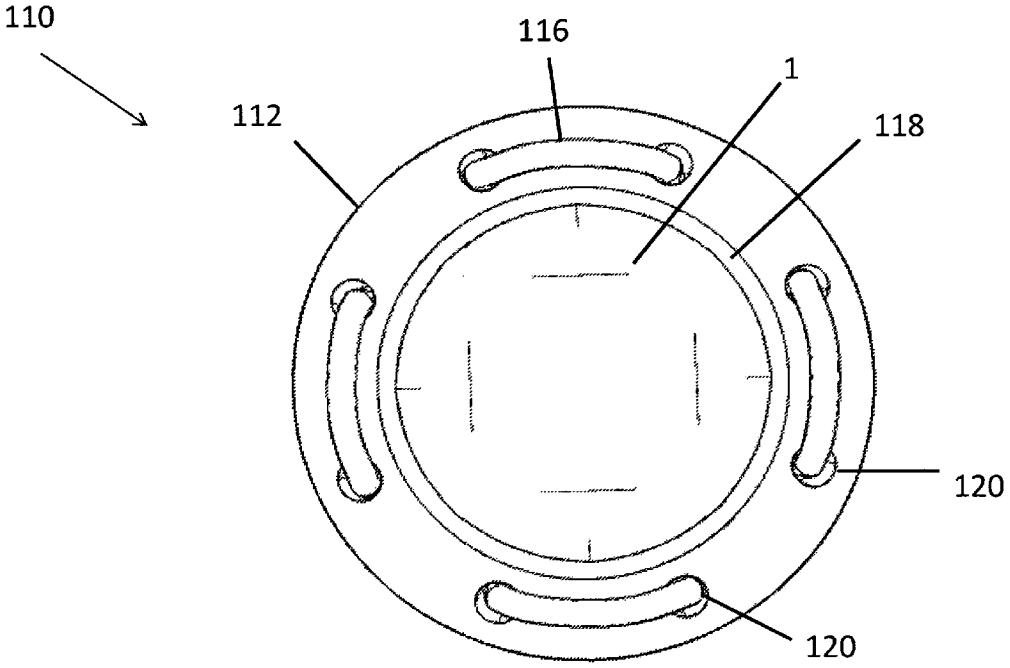
FIG. 2 is a top thereof.

The present invention relates to a jewelry mount for an ornamental article 1. The ornamental article can be a gem stone, precious stone, semi-precious stone, a faux stone (e.g., costume jewelry), or other ornamental article that may be incorporated into a piece of jewelry.

Referring to FIGS. 1-4, the jewelry mount 110 includes a first support 112, a second support 114, and a filament 116 that extends between the first and second supports. The first support 112 includes a receptacle 118 that is sized and shaped to receive a first portion of an ornamental article 1. The receptacle 118 can be an aperture, such as a thru-hole, so that the ornamental article 1 can be received into the aperture 118 from below the first support and that the ornamental article 1 can be viewed from above the first support through the thru-hole. A first plurality of holes 120 are arranged about a periphery of the first support 112. As discussed in more detail below, the holes 120 are sized and shaped to receive filament 116 in order to bind the first and second supports together.

As shown in FIGS. 1-4, the second support 114 can have a size less than the size of the first support 112. In other embodiments, the second support 114 can be equal or larger in size than the first support. In addition, the first and second supports are shown having the same, generally circular shape. However, the first and second supports can have various other shapes and the first and second supports can have different shapes than one another. The second support 114 includes a receptacle 122 that is sized and shaped to receive a second portion of the ornamental article 1. As can best be seen in FIGS. 3 and 4, the receptacle 122 can be a cone-shaped recess in the second support that is sized and shaped to receive the ornamental article from a top side of the second support. The receptacle 122 can also be a thru-hole or other feature that is sized to receive and support a portion of the ornamental article. The second support 114 can be concentrically aligned with the first support 112. The second support 114 includes a second plurality holes 124 arranged about a periphery of the second support. The holes 124 are sized and shaped to receive filament 116. Preferably, the first and second supports are aligned and oriented such that the first plurality of holes 120 are aligned with respective holes of the second plurality of holes 124.

Figure 3:
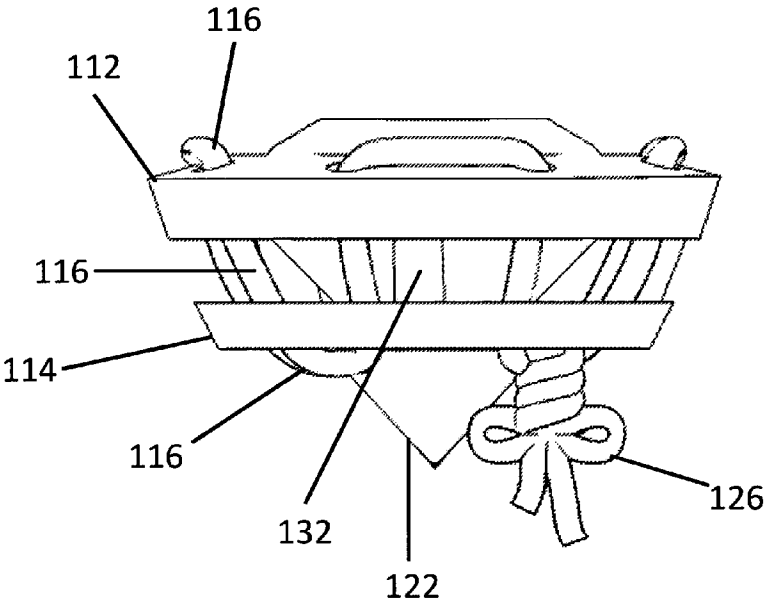
FIG. 3 is a side view thereof.

A filament 116 extends between and among the plurality of holes 120 and 124 in the first and second supports 112 and 114. The filament 116 can pass through the holes in a threaded manner such that the filament passes through aligned holes of the first and second plurality of holes in a first direction, then from one hole of the first or second plurality of holes to an adjacent hole thereof, and then through another set of aligned holes in a second direction. This undulating or sinusoidal threading pattern is repeated until the filament 116 passes between and through all the holes of in the first and second supports. As can be seen in FIG. 3, the second support 114 has a smaller diameter than the first support 112 so that adjacent sections of filament angle away from each other in the upward direction and angle toward each other in the downward direction.

Figure 4A:
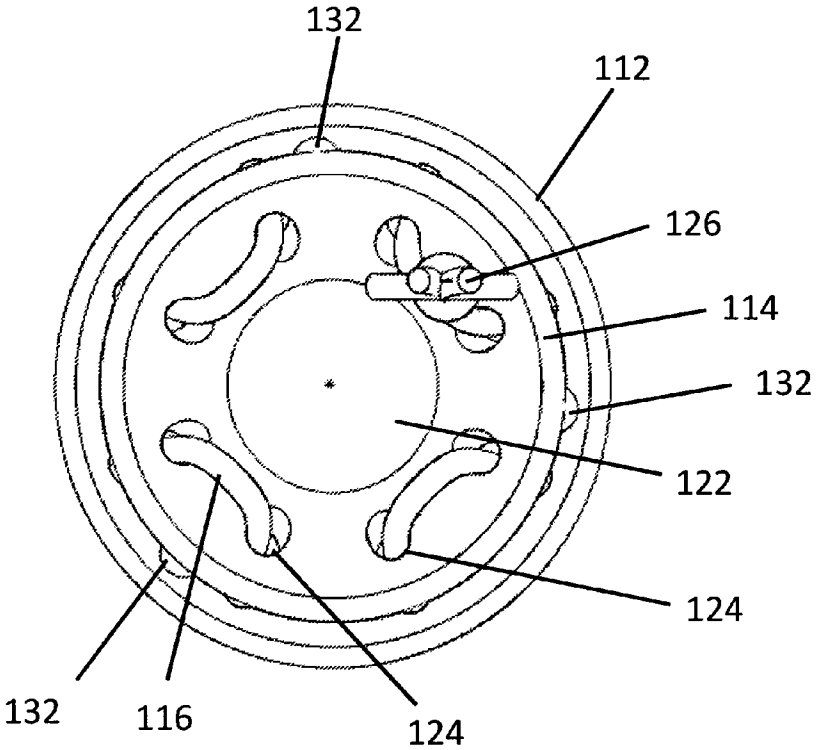
FIG. 4A is a bottom view thereof according to a first arrangement.
Figure 4B:
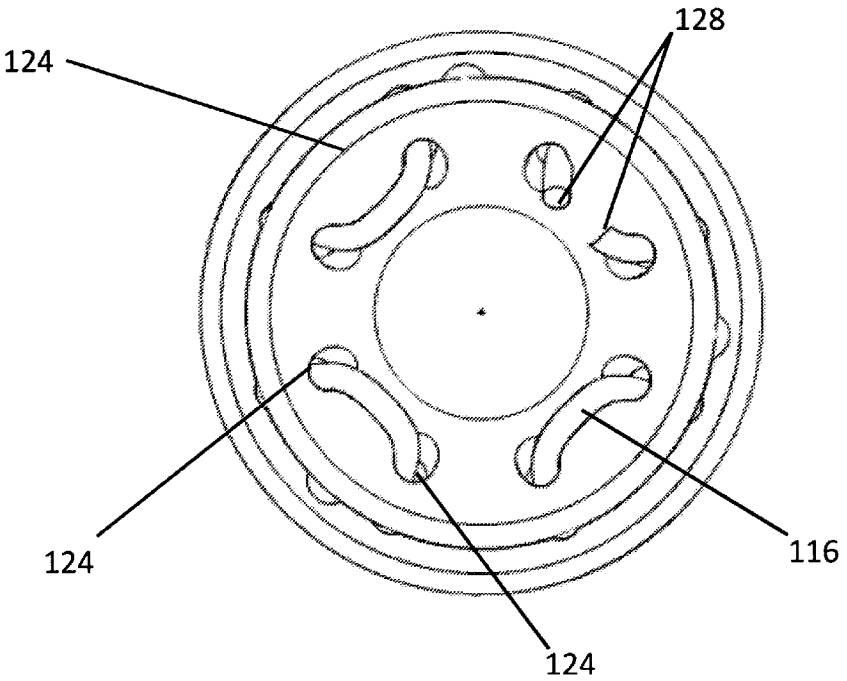
FIG. 4B is a bottom view thereof according to a second arrangement.
Figure 4C:
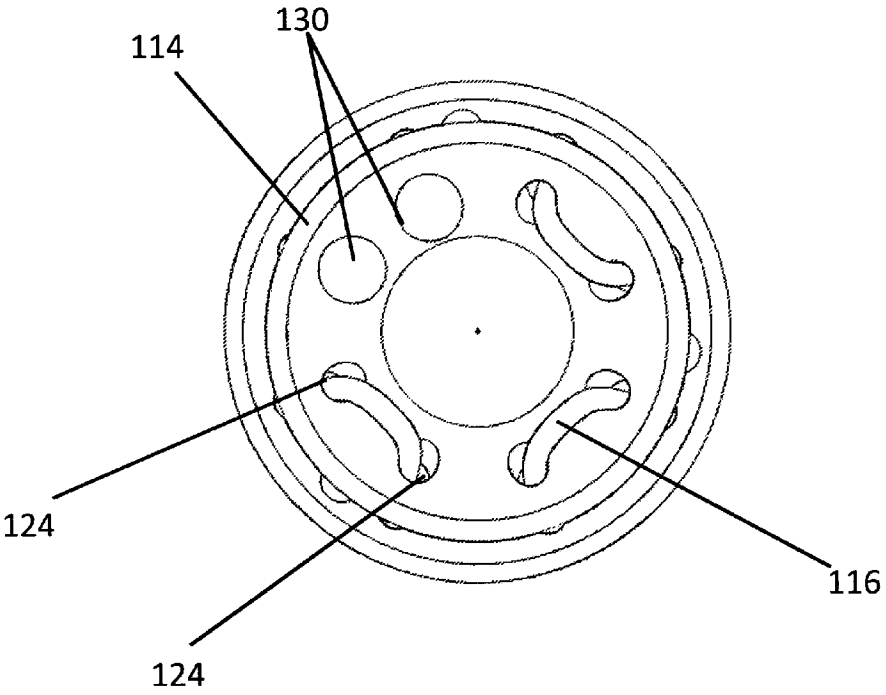
FIG. 4C is a bottom view thereof according to a third arrangement.

The filament 116 can be thread through the holes such that opposite ends of the filament are disposed proximate each other. Accordingly, the opposite ends of the filament 116 can be twisted together and a decorative piece 126, for example, a decorative bow, is attached to the opposite ends of the filament. As can be seen in FIG. 4A, this creates an aesthetically pleasing appearance of the ends of the filament being tied together. Alternatively, as shown in FIG. 4B, the ends of the filaments can terminate with open ends 128. In which case, a small piece of additional filament can be attached to the open ends (e.g., by soldering the piece) to create a continuous filament. The ends of the filament can also be long enough such that they can be bent together and attached to create a continuous filament without the need for a separate piece. As another alternative, as shown in FIG. 4C, the ends of the filaments can include end caps 130 that are larger in diameter than the filament and the plurality of holes 120, 124. The end caps can be attached to ends of the filaments to hold the filaments in place and prevent the filaments from passing back through the holes 120, 124 and thus "unraveling" the stitching of the filament. The end caps can have various suitable shapes, such as ball ends as shown, for example.

The filament 116 passes through the plurality of holes 120, 124 in the first and second supports 112, 114 so as to stitch the first and second supports together and thereby secure the ornamental article therebetween. The filament holds the first and second supports together, which in turn, hold the ornamental object between the first and second supports. Spacers 132 can be included between the first and second supports around the periphery of the supports. The spacers 132 assist in maintaining the first and second supports 112, 114 together and in proper alignment and at the proper spacing. The spacers can be attached to the first and second supports via various suitable means, including soldering them into place, for example. The use of the filaments and the first and second supports provides an aesthetically pleasing and secure mechanism of holding the ornamental article in place.

The materials used to manufacture the jewelry mount 110 can be made from precious metals, semi-precious metals, or other materials that are suitable for making ornamental accessories such as jewelry. The jewelry mount 110 can be incorporated into various pieces of jewelry, including, for example, rings, pendants, earrings, and other ornamental accessories. The various arrangements described in connection with FIGS. 1-4 can be altered to achieve different aesthetic arrangements without departing from the scope of the invention. For example, FIGS. 1-4 illustrate a single ornamental article supported between the first and second supports; however, the first and second supports can be provided with multiple apertures and receptacles for supporting multiple ornamental articles of varying sizes and shapes therebetween. The supports can also have various shapes in addition to the circular shape shown in the figures, including, for example, square, triangular, hexagonal, etc. and other suitable shapes. In addition, the "stitching pattern" of the filament may be varied and multiple filaments may be used to create intricate patterns in which certain filaments pass through certain holes while skipping others. Thus, many aesthetic combinations can be achieved by varying the number of peripheral holes 120,124 and arrangement and alignment in combination with various filaments and stitch patterns. For example, multiple filaments could be used to create a twisted stitched pattern.

It should be understood that various combination, alternatives and modifications of the present invention could be devised by those skilled in the art. The present invention is intended to embrace all such alternatives, modifications and variances that fall within the scope of the appended claims.

While the invention has been particularly shown and described with reference to a preferred embodiment thereof, it will be understood by those skilled in the art that various changes in form and details may be made therein without departing from the spirit and scope of the invention.

What is claimed is:

1. A jewelry mount for an ornamental article, comprising:

a first support, the first support defining a first receptacle sized and shaped to receive a first portion of an ornamental article, wherein the first support defines a plurality holes arranged about a periphery of the first support;

a second support, the second support having a size equal to or less than the size of the first support and the second support defining a second receptacle sized and shaped to receive a second portion of the ornamental article, the second support being concentrically aligned with the first support, wherein the second support defines a plurality holes arranged about a periphery of the second support;

a filament, wherein the filament extends in a threaded manner between and among the plurality of holes in the first support and the plurality of holes in the second support so as to stitch the first and second support together and thereby secure the ornamental article therebetween, wherein adjacent sections of the filament angle away from each other as they extend from the second support to the first support; and at least one spacer extending between the first and second supports.

2. The jewelry mount of claim 1, wherein the filament extends between the plurality of holes in the first support and the plurality of holes in the second support in a generally sinusoidal pattern.

3. The jewelry mount of claim 1, wherein the first and second supports support a single ornamental article therebetween.

4. A jewelry mount for an ornamental article, comprising:

a first support, the first support defining a first receptacle sized and shaped to receive a first portion of an ornamental article, wherein the first support defines a plurality holes arranged about a periphery of the first support and wherein the first receptacle is a thru-hole;

a second support, the second support having a size equal to or less than the size of the first support and the second support defining a second receptacle sized and shaped to receive a second portion of the ornamental article, the second support being concentrically aligned with the first support, wherein the second support defines a plurality holes arranged about a periphery of the second support; and a filament, wherein the filament extends in a threaded manner between and among the plurality of holes in the first support and the plurality of holes in the second support so as to stitch the first and second support together and thereby secure the ornamental article therebetween, wherein adjacent sections of the filament angle away from each other as they extend from the second support to the first support.

5. The jewelry mount of claim 4, wherein the second receptacle is a thru-hole.

6. The jewelry mount of claim 4, wherein the filament extends between the plurality of holes in the first support and the plurality of holes in the second support in a generally sinusoidal pattern.

7. The jewelry mount of claim 4, wherein the first and second supports support a single ornamental article therebetween.

* * * * *